US008926271B2

(12) United States Patent
Hiernaux

(10) Patent No.: US 8,926,271 B2
(45) Date of Patent: Jan. 6, 2015

(54) ABRADABLE FOR STATOR INNER SHROUD

(75) Inventor: Stéphane Hiernaux, Waremme (BE)

(73) Assignee: Techspace Aero S.A., Milmort (BE)

( * ) Notice: Subject to any disclaimer, the term of this patent is extended or adjusted under 35 U.S.C. 154(b) by 496 days.

(21) Appl. No.: 13/305,407

(22) Filed: Nov. 28, 2011

(65) Prior Publication Data

US 2012/0134787 A1 May 31, 2012

(30) Foreign Application Priority Data

Nov. 30, 2010 (EP) ..... 10193061

(51) Int. Cl.
*F01D 11/12* (2006.01)

(52) U.S. Cl.
CPC ..... *F01D 11/122* (2013.01)
USPC ..... 415/173.1; 415/173.4; 415/173.6; 415/174.4

(58) Field of Classification Search
USPC ..... 415/173.1, 173.4, 173.6, 174.4
See application file for complete search history.

(56) References Cited

U.S. PATENT DOCUMENTS 3,970,319 A * 7/1976 Carroll et al. ..... 415/173.4
4,329,308 A 5/1982 Langer et al.
4,652,209 A * 3/1987 Buddenbohm ..... 415/174.4
4,764,089 A * 8/1988 Strangman ..... 415/173.4
4,914,794 A * 4/1990 Strangman ..... 29/889.2
6,113,347 A * 9/2000 Forrester ..... 415/9
6,171,351 B1 * 1/2001 Schroder et al. ..... 51/295
6,177,174 B1 * 1/2001 Legrand ..... 428/141
6,863,496 B2 * 3/2005 Cho et al. ..... 415/173.5
6,874,990 B2 * 4/2005 Nadeau ..... 415/173.5
2001/0004436 A1 6/2001 Chasripoor et al.
2003/0175116 A1 9/2003 Le Biez et al.
2006/0110247 A1 5/2006 Nelson et al.

FOREIGN PATENT DOCUMENTS

FR 2 339 741 A1 8/1977
WO WO 95/34745 A1 12/1995

* cited by examiner

*Primary Examiner* — Igor Kershteyn

(74) *Attorney, Agent, or Firm* — Reinhart Boerner Van Deuren P.C.

(57) ABSTRACT

The present invention relates to a pressure seal (7) of a turbomachine stator, said seal (7) comprising a first abradable surface opposite a rotor portion of the turbomachine and a second surface in contact with an inner shroud (3) of the stator, said seal (7) comprising a plurality of component units (10), each component unit (10) having, on its first abradable surface, a circumferential step (9) creating an obstacle in the circumferential direction of the inner shroud (3).

13 Claims, 3 Drawing Sheets

ABRADABLE FOR STATOR INNER SHROUD

FIELD OF THE INVENTION

The present invention relates to a compressor or turbine stator for land, marine or aeronautic turbomachines. It more particularly relates to an abradable pressure seal of the stator.

STATE OF THE ART

The axial compressors of turbomachines comprise several rotary vane stages, also called rotor vanes, that are separated by rectifier stages which aim to reposition the velocity vector of the fluid leaving the previous stage before sending it toward the following stage, while slowing down the flow of the fluid, which causes an increase in its pressure.

Stators or rectifier stages are essentially made of fixed vanes, also called stator vanes, connecting an outer shroud to an inner shroud, both of which are concentric and delimiting the air flow zone or aerodynamic stream. The rotor vane stages are attached to a drum and an abradable is present on the inner shroud of the stator in order to ensure the sealing of the cavity situated between the stator and the drum. The abradable is placed under the inner shroud opposite sealing elements present on the drum or rotor. FIG. 1 shows a partial cross-section of a turbomachine and allows to visualize the rotor vanes 1, the stator vanes 2, the inner 3 and outer 4 shrouds of the stator, respectively, the drum 5, the sealing elements 6 of the rotor and the abradables 7 of the inner shrouds.

The sealing elements/abradable system forms a labyrinth intended to limit the recirculation flow rate under the stator caused by the pressure difference between the respective downstream and upstream portions of each stator stage and thus aims to increase the output of the compressor.

Currently, the abradable present under the foot of the stator has an axisymmetric shape, sometimes with stages, as illustrated in FIG. 2, and allows to obtain a pressure loss by opposing an obstacle (axial step 8) to the axial component (along the axis of the turbomachine) for the leakage flow. However, the flow, due to the rotation of the rotor vanes, also has a significant circumferential component to which the shapes of the current abradables do not offer any obstacles.

Aim of the Invention

The present invention aims to provide a new family of abradables having a non-axisymmetric shape allowing to generate a greater pressure loss and thereby ensuring better sealing.

SUMMARY OF THE INVENTION

The present invention relates to a pressure seal of a turbomachine stator, said seal comprising a first abradable surface opposite a rotor portion of the turbomachine and a second surface in contact with an inner shroud of the stator, said seal comprising a plurality of component units, each component unit having, on its first abradable surface, a circumferential step creating an obstacle in the circumferential direction of the inner shroud.

According to specific embodiments of the invention, the seal comprises at least one or a suitable combination of the following features:

- each component unit also comprises, on its first abradable surface, an axial step creating an obstacle in the axial direction of the turbomachine;

- the circumferential step and the axial step of the component unit define the contours of a profile that may assume a plurality of distinct shapes;
- the component units have profiles and/or dimensions that vary in the circumferential direction of the inner shroud;
- the profiles of the different component units are offset in the axial direction of the turbomachine;
- the component units have a same profile that repeats periodically along the circumference of the inner shroud, thus forming repetitive units;
- each repetitive unit covers in the circumferential direction of the inner shroud an angular sector corresponding to four to ten pitches of the rotor vanes driven by said rotor portion;
- the rotor portion opposite the first abradable surface comprises sealing elements secured to a drum;
- the seal is made of silicone or epoxy.

The present invention also relates to a turbomachine stator comprising at least one pressure seal such as described above.

Figure 1:
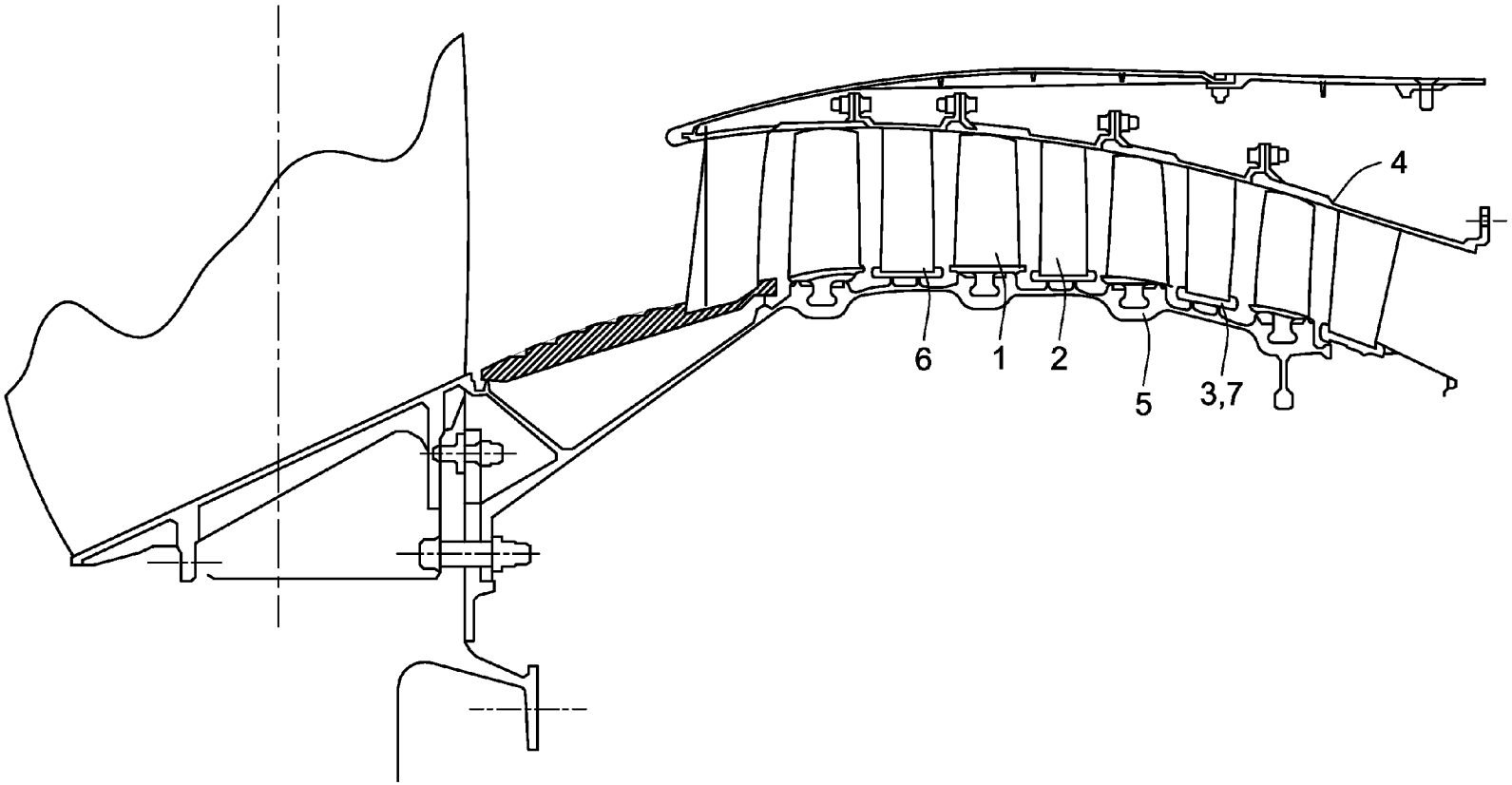
FIG. 1 shows a partial axial cross-section of a turbomachine as in the state of the art.
Figure 2:
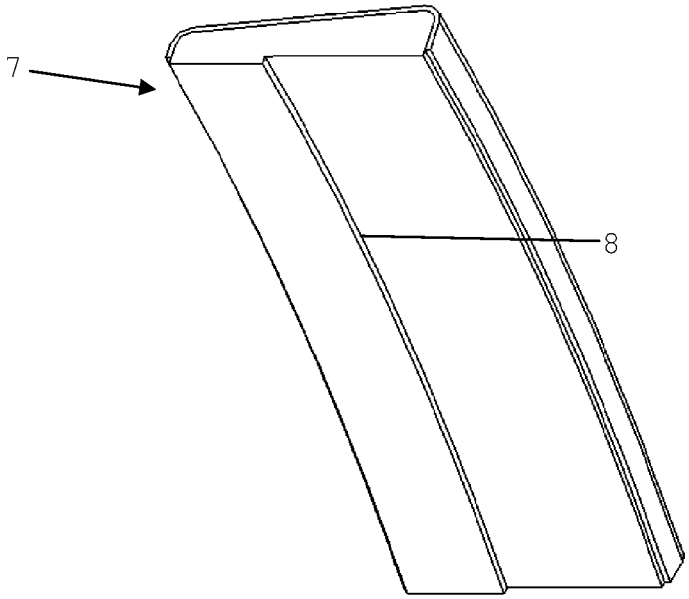
FIG. 2 shows a portion of an abradable as in the state of the art.

KEY (1) Rotor vane
(2) Stator vane
(3) Inner shroud
(4) Outer shroud
(5) Drum
(6) Sealing element
(7) Abradable or pressure seal
(8) Axial step of the abradable track
(9) Circumferential step of the abradable track
(10) Component unit of the abradable

DETAILED DESCRIPTION OF THE INVENTION

As already mentioned, the efficiency of the labyrinth created by the sealing elements/abradable system is conditioned by the pressure losses generated through the latter. One of the mechanisms used to increase the pressure losses is to create steps in the abradable that force the creation of loss-generating vortices. The present invention is based on the fact that the flow in the cavity is not strictly axial, but has a strong girational component resulting from the primary flow in the stream.

Figure 3:
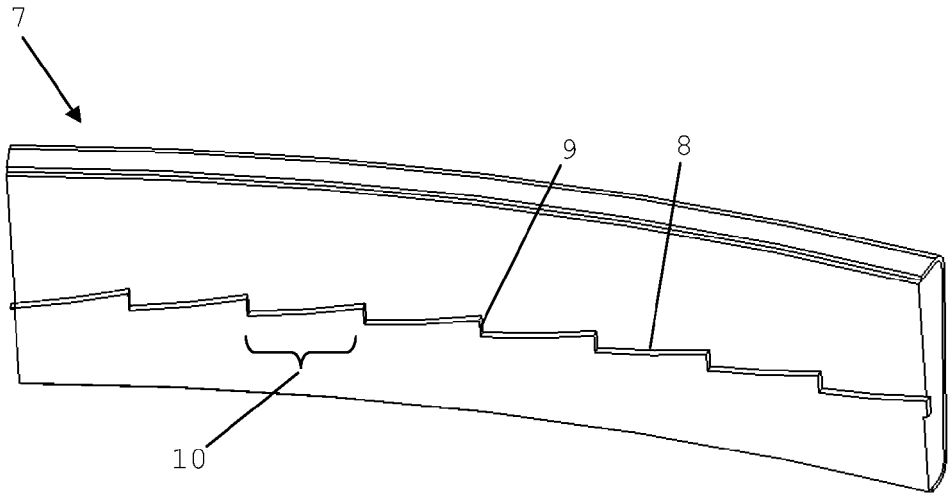
FIG. 3 shows eight component units of an abradable as in the invention.

Thus, according to the invention, the abradable 7 and more specifically the track of the abradable, i.e. the surface opposite the sealing elements, also comprises steps in the circumferential direction (i.e. in the circumferential direction of the inner shroud) in order to further increase the pressure losses. FIG. 3 shows a portion of the abradable 7 as in the invention comprising eight axial steps 8 and eight circumferential steps 9 on the abradable track. The entire abradable 7 is made of a plurality of component units 10 each comprising an axial step 8 and a circumferential step 9. In the example of FIG. 3, eight component units 10 of the abradable 7 are thus shown.

Figure 4:
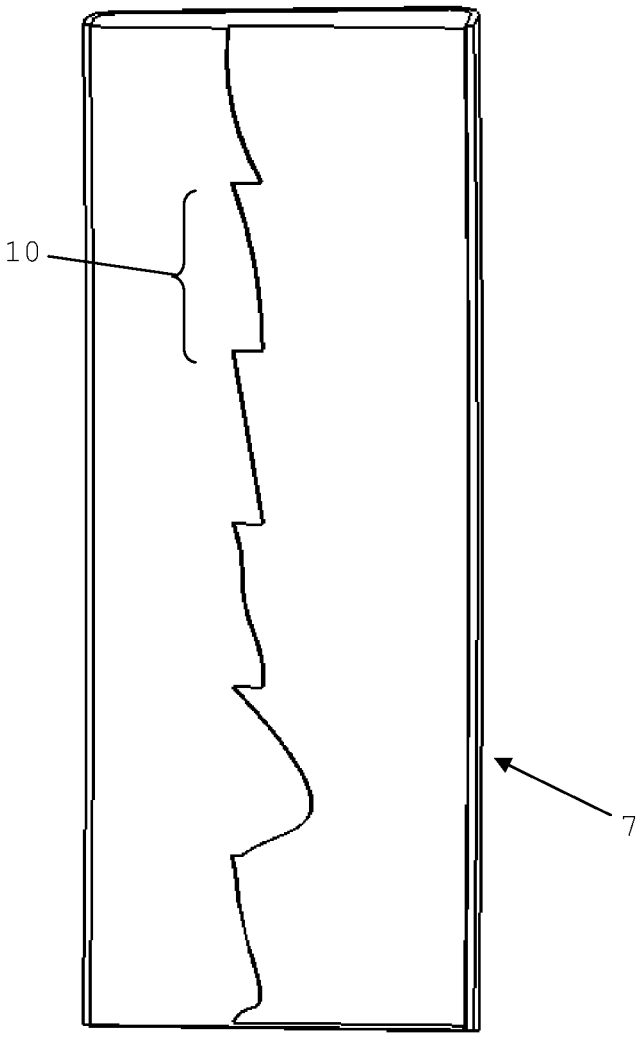
FIG. 4 shows a plurality of shapes that can be assumed by the profile of the component units of the track of the abradable as in the invention.

The circumferential step 9 and the axial step of the component unit 10 define the contours of a profile that may assume several shapes. For information and non-limitingly for the present invention, FIG. 4 shows six different profiles of the component units of the abradable track. According to the invention, any abradable comprising circumferential steps allowing to generate a pressure loss is suitable.

The units making up the abradable may have, on their abradable tracks, a same profile or different profiles, just as they may have the same dimension in the circumferential direction or have different dimensions. In FIG. 3, the profiles of the units 10 are identical or similar and aligned in the circumferential direction. According to the invention, the profiles may also be offset relative to one another in the axial direction of the turbomachine. Preferably, the component units have a cyclic repetitiveness in light of the cyclic nature of the shroud, which is then called a repetitive unit. Still preferably according to the invention, the repetitive unit covers an angular sector corresponding to four to ten pitches of the mobile vanes driven by the drum.

The profiles of the component units generally cannot be produced by turning, as is currently the case. However, the profile may easily be obtained by molding with finished or quasi-finished side(s), in particular on shroud sectors.

Preferably, the abradable is made of silicone or epoxy.

The present invention also extends to abradable pressure seals whereof each component unit is deprived of any axial step and therefore only comprises a circumferential step.

ADVANTAGES OF THE INVENTION

The circumferential component of the leakage flow generally being much more significant than the axial component, the obstacle formed by the circumferential steps as in the invention allows a more substantial pressure loss and therefore increased efficiency relative to traditional shapes.

The invention claimed is:

1. A pressure seal (7) of a turbomachine stator, said seal (7) comprising a first abradable surface opposite a rotor portion of the turbomachine and a second surface in contact with an inner shroud (3) of the stator, the first abradable surface of the seal (7) having a stepped profile and comprising a plurality of component units (10), each component unit (10) comprising:

a circumferential step (9) creating an obstacle in the circumferential direction of the inner shroud (3), and an axial step (8) creating an obstacle in the axial direction of the turbomachine.

2. The pressure seal (7) as in claim 1, wherein the circumferential step (9) and the axial step (8) of the component unit (10) define the contours of a profile that may assume a plurality of distinct shapes.

3. The pressure seal (7) as in claim 2, wherein the component units (10) have profiles and/or dimensions that vary in the circumferential direction of the inner shroud (3).

4. The pressure seal (7) as in claim 2, wherein the profiles of the different component units (10) are offset in the axial direction of the turbomachine.

5. The pressure seal (7) as in claim 2, wherein the component units (10) have a same profile that repeats periodically along the circumference of the inner shroud (3), thus forming repetitive units.

6. The pressure seal (7) as in claim 5, wherein each repetitive unit covers, in the circumferential direction of the inner shroud (3), an angular sector corresponding to four to ten pitches of the rotor vanes (1) driven by said rotor portion.

7. The pressure seal (7) as in claim 1, wherein the rotor portion opposite the first abradable surface comprises sealing elements (6) secured to a drum (5).

8. The pressure seal (7) as in claim 1, wherein said seal (7) is made of silicone or epoxy.

9. A turbomachine stator comprising at least one pressure seal (7) as in claim 1.

10. The pressure seal (7) of claim 1, wherein the first abradable surface is free of cavities.

11. The pressure seal (7) of claim 1, wherein the stepped profile consists of only one of the axial step.

12. The pressure seal (7) of claim 1, wherein the first abradable surface includes a raised section along a raised annular side, and a recessed section along a recessed annular side, said circumferential step being closer to the raised annular side than the recessed annular side.

13. The pressure seal (7) of claim 1, wherein each of the component units share the a first common maximum depth for the circumferential step (9) and share a second common maximum depth for the axial step (8).

* * * * *